United States Patent [19]

Fleck et al.

[11] Patent Number: 4,582,018

[45] Date of Patent: Apr. 15, 1986

[54] SELECTABLE MEDICAL INDICATOR

[76] Inventors: John E. Fleck, 2020 Dogwood Dr.; David A. Fleck, 1702 37th Way S.E., both of Auburn, Wash. 98002

[21] Appl. No.: 621,171

[22] Filed: Jun. 15, 1984

[51] Int. Cl.[4] ..... G09F 11/00; B42F 1/10

[52] U.S. Cl. ..... 116/321; 116/324; 24/551; 24/563

[58] Field of Search ..... 40/5, 11 R, 17, 18, 40/359, 491; 116/312, 315, 319, 321–324, 234–239; 281/37; 24/67.3, 67.5, 545, 546, 551–554, 563

[56] References Cited

U.S. PATENT DOCUMENTS

| | | | |
|---|---|---|---|
| D. 256,258 | 8/1980 | Varrin | D19/65 |
| 2,731,941 | 1/1956 | Anderson | 116/324 |
| 2,814,139 | 11/1957 | Clare | 40/109 |
| 3,219,009 | 11/1965 | Olsen | 116/319 |
| 3,304,907 | 2/1967 | Block | 116/319 |
| 3,348,272 | 10/1967 | Germani | D19/65 |
| 3,397,434 | 8/1968 | Arblaster | 116/237 |
| 3,903,837 | 9/1975 | Barton et al. | 116/315 |
| 4,041,893 | 8/1977 | Mulloy | 116/318 |
| 4,213,463 | 7/1980 | Osenkarski | 116/322 |

*Primary Examiner*—Charles Frankfort
*Assistant Examiner*—W. Morris Worth
*Attorney, Agent, or Firm*—Roy E. Mattern, Jr.

[57] ABSTRACT

A selectable medical indicator is adapted for removable attachment to the outside cover of a medical record binder or a medical chart holder, so medical personnel may preset color indicia at a viewing slot, to thereafter signal other medical personnel as to the treatment to be rendered to a patient. A preferred embodiment comprises the assembly of three injection molded parts. The first part is a rectangular indicator having multiple transverse color stripes and an integral resilient side finger manipulator actuator. The second part is a back body having integral resilient depending prongs serving a clipping function, with the outside of the back body cooperatively serving this clipping function, and with the inside of the back body serving a guiding function for the rectangular indicator. The third part is a front body having an inside recess serving a guiding function for the rectangular indicator, a transverse front viewing slot for observing a selected color stripe, and side accessible detents for selectively positioning the finger manipulated indicator to present and to hold a selected color stripe at the viewing slot.

7 Claims, 8 Drawing Figures

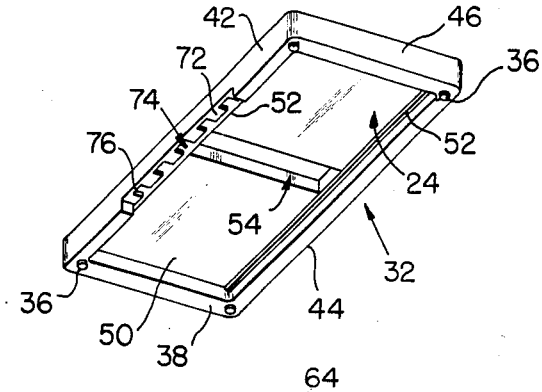
FIG. 5
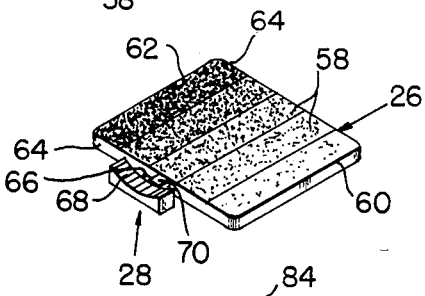
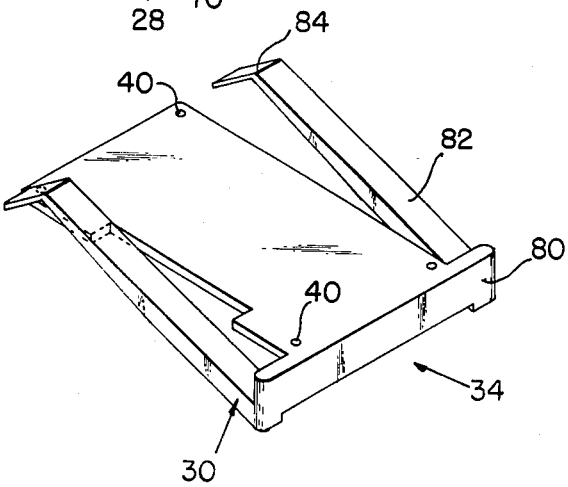
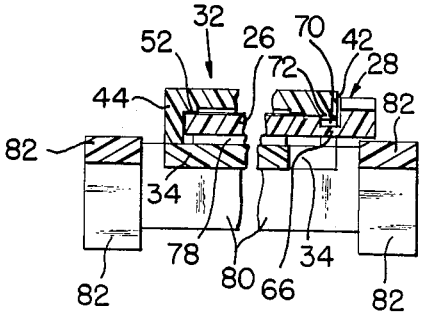
FIG. 6
FIG. 7
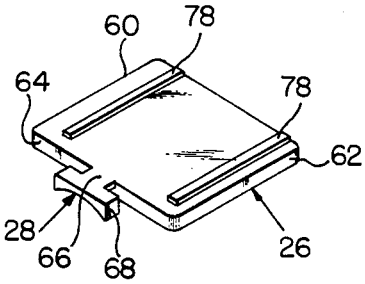
FIG. 8
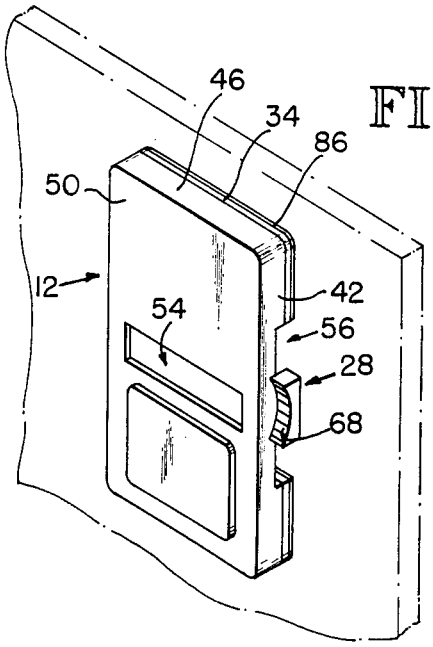

SELECTABLE MEDICAL INDICATOR

BACKGROUND

Many devices for the medical industry have been developed which provide information regarding required medical treatment or the status of a patient's file. Most of these devices require the medical staff member to observe several items of information on the file or chart holder, or to complete a series of manual tasks with regard to the device in order to display information and maintain current file history.

Edward Mulloy, U.S. Pat. No. 4,041,893, presents a reference device to indicate required medical procedures. Multiple rotary dials must be turned in addition to adjusting sliding indicators to present various indicia through multiple viewing windows, sliding scales and the dials.

D. Arblaster, U.S. Pat. No. 3,397,434 has provided a file chart clip to be secured to a chart holder to indicate whether or not a series of presurgical steps have been completed. In its preferred embodiment the names of the various procedures are printed on the clip such that a slider tab is moved to cover each printed procedure as it is completed and spell out a message that the patient is ready for surgery.

Other inventions such as that of Elsie Anderson, U.S. Pat. No. 2,731,941 have been developed which merely operate as a signal without providing more information to the doctors or nurses regarding the patient's care status. Anderson's chart holder warning signal uses a sliding mechanism to indicate whether the doctor's orders have been carried out or not. Rather than providing information as to the specific services, the signal is merely a two way signaling device, operating in one of two selected positions.

A hospital chart holder warning signal unit was provided by George Block, U.S. Pat. No. 3,304,907 in which a movable disk with a viewing area is rotated on a static disk to preselected positions to indicate information regarding treatment.

A primary objective of the present invention is to provide a novel medical indicating device which would alternatively display a variety of selectable colors or other indicia to represent required medical services.

A further objective is to provide an indicator which conveys necessary medical information without requiring time consuming review of several sources of data or require much manual operation.

A further objective is to provide a light, compact medical indicating device which may be attached and removed easily and is less bulky on the file or chart holder.

A further objective is to provide a medical indicating device which may be molded from a light plastic or similar material requiring fewer mechanical parts.

SUMMARY OF THE INVENTION

A selectable medical indicator is secured to the binding or cover of chart holders to alternatively present a variety of selectable colors or other indicia to medical personnel which represent required medical services or treatment. The medical indicator is preferably injection molded as three main components and consists of an indicator plate which is slidingly secured within a rectangular body comprising a front and back member. Multiple transverse color stripes on the surface of the indicator plate may be alternatively presented through a viewing slot in the rectangular body, each representing a different required service or status of the patient's care. A latching assembly is comprised of a detent ridge on the actuator which selectably seats within notches spaced apart along the interior surface of a rectangular body. In the latched position, the indicator plate fully presents the preselected color stripe and will remain where placed and not move accidentally.

A spring clip is preferably moldably formed with the back member of the rectangular body to attach the indicator to the binding or the cover of the medical chart holder. An adhesive material may be used as alternative mounting means eliminating the need for a clip.

DESCRIPTION OF THE DRAWINGS

FIG. 5 is an exploded view of the selectable medical indicator showing the three main components including the front member, rectangular indicator plate, and back member.

FIG. 6 is a partial cross section view taken along line 6—6 of FIG. 2 particularly showing each side of the indicator plate as it fits into the molded front member.

FIG. 7 is a perspective view of the bottom surface of the indicator plate showing the ribs.

FIG. 8 shows a portion of the cover of a medical chart holder with the indicator being secured to the holder by a layer of adhesive material as an alternative mounting means.

DESCRIPTION OF THE PREFERRED EMBODIMENTS

Introduction

In hospitals, health centers and other medical facilities, patient charts and files usually require constant monitoring and review by nurses, doctors and other staff members to determine the particular form of treatment and other current information regarding the patient care. There are often large numbers of medical chart holders and file holders which must be stored for easy accessibility and observation by the medical personnel.

The present invention provides a selectable medical indicator 12 for medical file or chart holders 14 to quickly indicate to medical personnel the required services or treatment for patients.

The preferred embodiment of the selectable medical indicator 12 or indicator 12 incorporates a color coding system whereby a preselected color stripe 58, designating a particular service, is adaptively positioned in the indicator to be easily viewed by the nurse or doctor. An indicator is secured to the outside of each medical chart holder 14 and may thus quickly convey the necessary information regarding the required treatment for a patient at a glance without requiring a more time consuming review or opening of the file.

Figure 1:
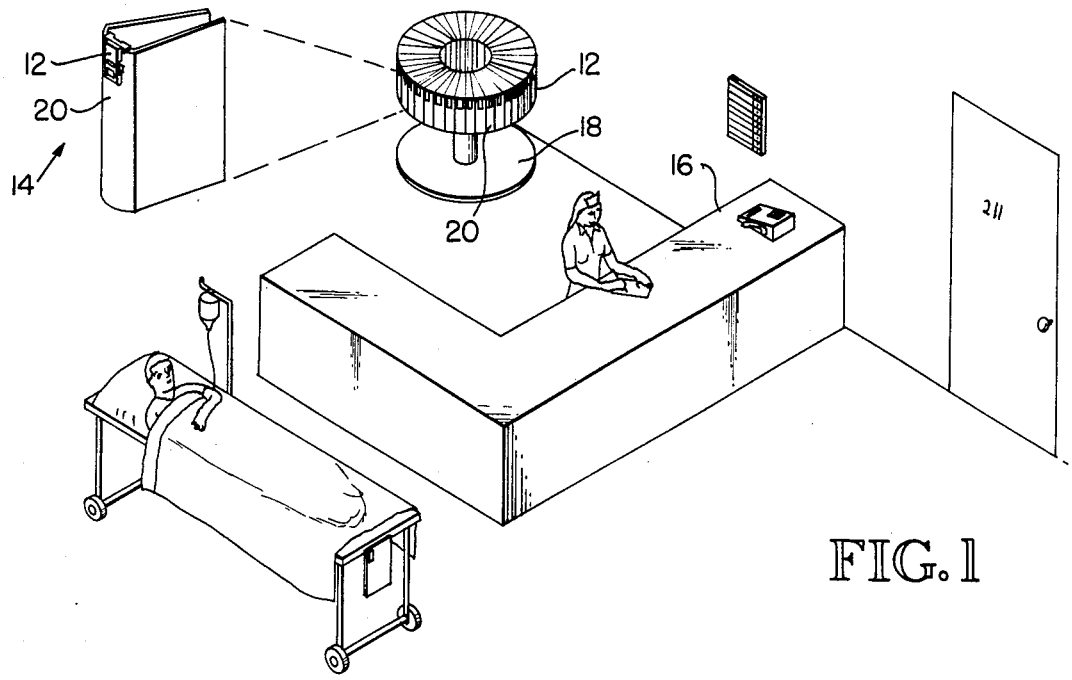
FIG. 1 represents a hospital or health center nurse station in which multiple medical chart holders are maintained and stored, each having a selectable medical indicator secured to its binding. One chart holder is enlarged to show the indicator in more detail.

FIG. 1 illustrates a nurses station in a hospital where typically a large number of patient file and chart holders 14 are stored. Behind the counter 16, medical chart holders 14 are arranged for multiple viewing, such as on a carousel 18, whereby an indicator 12 is secured to the outside of the binding 20 of each chart holder. To expedite the process of making rounds, for example, the physician, could see the patient's name in addition to the preselected color of the indicator on the outside of each of several chart holder as he or she glances at the carousel to quickly determine the proper procedures for treatment for several patients.

The Selectable Medical Indicator Broadly Comprises a Rectangular Body, Rectangular Indicator Plate and a Mounting Means for Attachment to a Chart Holder As shown in FIGS. 2 through 6 of the drawings, the indicator includes a rectangular body 22, having a hollow rectangular interior 24, a rectangular indicator plate 26, a finger manipulated actuator 28 and a means to secure the indicator 12 to the chart holder 14, such as a spring clip 30. The indicator plate 26 is slidingly secured within the hollow interior 24 of the rectangular body 22 and positioned by the finger manipulated actuator 28 or actuator 28 which is secured to the indicator plate 26.

The Rectangular Body of the Selectable Medical Indicator

The rectangular body is further comprised of a hollow front member 32, serving as the viewing side of the indicator, and a back member 34, serving generally as the mounting side of the indicator.

The front 32 and back 34 members, as well as other components of the indicator 12, are preferably made of light plastic and formed from an injection molding process. This process permits reduced cost and ease of manufacture of particular elements or features of the indicator which will be discussed in more detail. The front 32 and back 34 members may be secured together whereby pins 36 are molded to and extend from the mating surface 38 of the front member 32 at each corner to be inserted into a corresponding aperture 40 in the back member 34 as shown in FIG. 5. The front member includes right 42 and left 44 sides, a top side 46, bottom side 48 and a cover plate 50 in which their interior surfaces define a channel within which the indicator plate 26 slidingly travels and may be secured as shown in FIGS. 5 and 6. Additionally, elevated elongated strips 52 extend along the interior surface of the right 42 and left 44 sides of the front member 32 to form a track upon which the top surface of the indicator plate slidingly travels.

Figure 2:
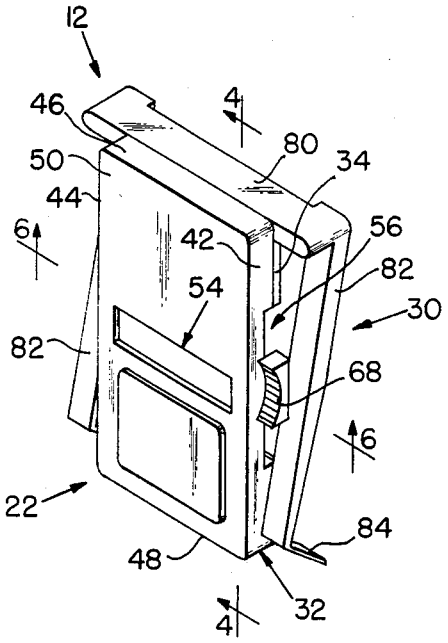
FIG. 2 is a perspective view of the indicator including the preferred clip as a mounting means.

An elongated transverse viewing slot 54 is centrally positioned on the cover plate 50 of the front member 32, extending into the hollow interior 24 and through which a color stripe 58 on the indicator plate may be observed as shown in FIGS. 2 and 8.

The back member 34 has a substantially flat interior surface which compressibly and slidingly communicates with the bottom of the indicator plate.

An actuator slot 56 is formed within the elongated right side of the rectangular body 22, through which the actuator 28 extends and which permits the up and down travel thereof. The actuator slot 56 is further comprised of a centrally located cutaway portion in the elongated right side of the front member when observing the viewing side of the indicator. The correlating central portion of the right side edge of the back member interior surface is indented such that the cut out portions of the attached front 32 and back 34 members together define the actuator slot 56 as shown in FIGS. 2 and 8.

The Indicator Plate of the Selectable Medical Indicator

The rectangular indicator plate 26, as previously described, is slidingly secured within the hollow interior 24 of the rectangular body 22. In its preferred embodiment, the front surface of the indicator plate 26 includes a plurality of transverse color stripes 58, contiguously positioned between and inclusive of the top 60 and bottom 62 edges of the indicator plate 26 as shown in FIG. 5. The indicator plate 26 is sized in terms of thickness to provide a clearance between the front surface of the indicator plate 26 and the cover plate 50 to allow the color stripes 50 to be changed. The color stripes 58 extend laterally between the edges of the sides 64 of the indicator plate. Each color stripe 58 is substantially equal in size and shape to the elongated viewing slot on the front member so that each stripe 58 may be alternatively fully presented through the viewing slot 54 to indicate a particular procedure or required medical treatment. The color stripes 58 may be applied to the indicator plate 26 as a decal or with paint, for example. Alternative embodiments of the indicator plate may utilize symbols or words to be presented in a viewing slot to convey the necessary medical information rather than the color coding system.

The Finger Manipulated Actuator of the Medical Indicator

The actuator 28 is secured to the indicator plate 26, being centrally located along its right side edge, to extend through the actuator slot as shown in FIGS. 2 and 8. The actuator is slidingly moved up and down within the actuator slot 56 to variably position the indicator plate 26 so as to present alternative color stripes. As shown in FIGS. 5 and 6, the actuator 28 is further comprised of an arm 66, depending from the edge of the indicator plate, and a selector tab 68, which is secured to the end of the arm 66. As in the preferred embodiment, the arm 66 and selector tab 68 may be molded as a single member, with the indicator plate 26 to form an extension thereof. The end of the selector tab 68 is contoured in a concave manner to permit the thumb or finger to rest securely on the tab 68 as it is slidingly pushed up and down to move the indicator plate 26. Additionally, the end and sides of the selector tab 68 may be serrated with closely spaced transverse ridges molded into their surfaces to keep the thumb or finger from sliding off the tab 68 during use.

Securing the Indicator Plate in Place is Accomplished by Latching the Actuator in Multiple Positions Along the Actuator Slot A detent ridge 70 is integrally molded to the top surface of the arm 66, depending upwardly to adaptively seat selectively and alternatively between a plurality of raised stops 72. The raised stops 72 are spaced apart and depend from the elevated strip proximate the actuator slot 56. The vertically positioned raised stops 72 define notches 74 between them which receive the detent ridge 70 as illustrated by the sectional view in FIG. 4 of the drawings.

The raised stops are preferably molded with the under surface of the cover plate 50 of the front member 32 as protrusions in the elevated strips 52. The stops 72 are also integrally formed with and abut the retaining ridge 76 which further defines the top edge of the actuator slot 56. In a selected latached position, the finger manipulated actuator 28 is secured in place by the detent ridge 70 which is sized to fit snugly between two raised stops 72 and abut the retaining ridge 76.

A Pair of Transverse Ribs Permit the Deflection of the Indicator Plate and Provide Detent Spring Latching Capabilities of the Actuator as Well as Facilitate Sliding Movement of the Indicator Plate A pair of transversely positioned ribs 78 are integrally formed with and spaced apart on the back surface of the indicator plate 26 proximate each end as shown in FIGS. 6 and 7. In an inactive latched position, the indicator plate is compressibly held between the back and front members via resistance of the ribs, whereby the detent ridge 70 of the actuator 28 engages a notch 74. Space created by the ribs 78 between the back surface of the indicator plate 26 and the interior surface of the back member 34 permits the deflection of the plate 26 near its middle, by depressing the selector tab 68, as well as the resulting detent spring capability of the actuator 28. To secure the desired colored stripe 58 within the viewing slot 54, the user simply depresses the selector tab 68 of the actuator to unseat the detent ridge 70. While depressed, the actuator 28 is slidingly moved up or down within the actuator slot 56 until the required stripe 58 is fully presented and the selector tab 68 is released to seat the detent ridge 70 in the adjacent notch 70. Each stripe is adaptively positioned and sized to be alternatively fully displayed when the actuator 28 is secured in a latched position.

The ribs 78 also provide elevated sliding, surfaces for the back of the indicator plate 26 thereby reducing friction during movement of the indicator plate.

Mounting the Medical Indicator to a Chart or File Holder

Figure 3:
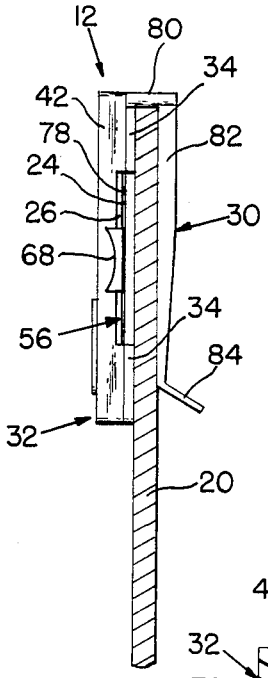
FIG. 3 is a side view of the indicator as it is secured to the binding or cover of a chart holder by the clip.
Figure 4:
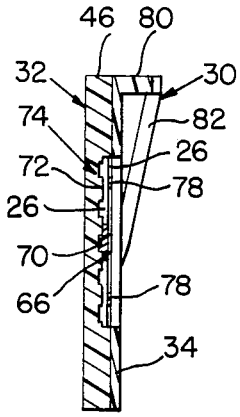
FIG. 4 is a cross section view of the indicator taken along line 4—4 of FIG. 2 showing the arm of the finger manipulated actuator wherein the detent ridge is seated within a notch in the front member of the rectangular body to latch the actuator and secure the indicator plate in place.

The preferred embodiment of the indicator 12, as shown in FIGS. 2 and 5, illustrates the spring clip 30 used to attach the medical indicator 12 to a chart holder 14. FIG. 3 shows the mounted indicator 12 whereby the clip 30 engages the binding 20 or cover of the chart holder 14, shown in a side view. The spring clip 30 may be integrally molded with the back member 34, as shown in FIG. 5, having a shoulder support 80 and a pair of elongated prongs 82 which depend from the ends of the shoulder support 80.

The shoulder support 80 depends rearwardly in coplanar alignment with the top side 46 of the rectangular body 22. The shoulder support 80 extends laterally beyond the sides of the rectangular body 22. The prongs 82 depend from the rear edge of the shoulder support, extending downward as shown in FIGS. 2 and 3. When the clip 30 is in an inactive position removed from the chart holder 14, the prongs 82 angle forward on a bias, intersecting the plane of interface of the mating surface of the front 32 and back 34 members and extend to a position adjacent to the cover plate 50 of the front member 32. The tip 84 of each prong is bent in a rearward fashion at an angle at facilitate attachment of the indicator 12 to the medical chart holders 14.

When attaching the spring clip 30 to the chart holder, the prongs 82 are bent back to a position substantially parallel to the rectangular body and the binding 20 or cover of the chart holder is inserted between the prongs 82 and back member 34. The resulting compressive clamping force exerted by the prongs against the binding or cover retains the medical indicator 12 securely in place on the chart holder 14 as shown in FIG. 3.

An alternative means of mounting the indicator is provided by applying a layer of adhesive material 86 to the back member 34. The exposed adhesive surface may then be securely bonded to the chart holder 14 as shown in FIG. 8, thereby eliminating the need for a clip 30 or similar attachment means.

We claim:

1. A selectable medical indicator adapted for removable attachment to medical record binders or medical chart holders, to indicate via a selective presentation of a selective color, the needed treatment of a patient, comprising:

(a) a rectangular indicator planar plate having multiple transverse color stripes and an integral resilient side finger manipulator actuator;

(b) a back body having attachment means on a back side for securing the back body to a binder or a chart holder, a planar surface on a front side to guide sliding movement of the smaller rectangular indicator planar plate, and (c) a complementary front body fitting the back body, having an inside planar recess serving a guiding function for the sliding movement of the rectangular indicator planar plate, a transverse front viewing slot for observing a single selected color stripe, and side accessible detents for selectively positioning the finger manipulator actuator to present and to hold said single selected color stripe at the viewing slot.

2. A selectable medical indicator, as claimed in claim 1, wherein the attachment means on the back side of the back body for securing the back body to a binder or a chart holder, comprises releasible pressure sensitive adhesive.

3. A selectable medical indicator, as claimed in claim 1, wherein the attachment means on the back side of the back body for securing the back body to a binder or a chart holder, comprises two integral transversely spaced depending prongs initially positioned in an intersecting position with respect to the extended vertical plane that is also occupied by the interfitted back body and front body, whereby the back side of the back body and these two integral prongs serve a clipping function.

4. A selectable medical indicator as claimed in claim 3, wherein the rectangular indicator planar plate has spaced transverse ribs on its' back side for slidably bearing against the planar surface on the front side of the back body, and for creating a deflectable resilient portion between the spaced transverse ribs of said indicator planar plate, which is utilized to create a spring effect, when the finger manipulator actuator is depressed to move a different colored transverse color stripe on said indicator planar plate for observation through the transverse front viewing slot.

5. A selectable medical indicator adapted for removable attachment to medical record binders or medical chart holders to indicate, via a selective presentation of a selective color, the needed treatment of a patient, comprising:

(a) a rectangular indicator planar plate having multiple transverse color stripes and an integral resilient side finger manipulator actuator;

(b) a rectangular hollow interior body larger than the rectangular indicator planar plate, whereby this rectangular indicator planar plate may be moved within said hollow body, having:

(i) a back body portion having attachment means on a back side for securing the back body portion to a binder or to a chart holder, a planar surface on a front side to guide sliding movement of the smaller rectangular indicator planar plate; and (ii) a front body portion, complementary fitting the back body portion having an inside planar recess creating a hollow interior and serving a guiding function for the sliding movement of the rectangular indicator planar plate, a transverse front viewing slot for observing a single selected color stripe, and side accessible detents for selectively positioning the integral resilient side finger manipulator actuator of the rectangular indicator planar plte to present and to hold said single selected transverse color stripe at the viewing slot.

6. A selectable medical indicator, as claimed in claim 5, wherein the attachment means on the back side of the back body portion for securing the back body to said binder or chart holder comprises two integral transversely spaced depending prongs initially positioned in an intersecting position with respect to an extended vertical plane, that is also occupied by the complementary fitting back body portion and front body portion, whereby the back side of the back body and said integral prongs serve a clipping function thereby securing the back body to said binder or chart holder.

7. A selectable medical indicator, as claimed in claim 6, wherein the rectangular indicator planar plate back side has spaced transverse ribs for slidably bearing against the planar surface on a front side of the back body, and for creating a deflectable resilient portion of the rectangular indicator planar plate located between these spaced transverse ribs, which is utilized to create a spring effect, when the finger manipulator actuator is depressed to move a different colored transverse color strips of said indicator planar plate for observation through the transverse viewing slot.

* * * * *